US006053388A

United States Patent [19]

Pfister et al.

[11] Patent Number: 6,053,388

[45] Date of Patent: Apr. 25, 2000

[54] SETTING TOOL

[75] Inventors: Norbert Pfister, Montlingen; Mario Grazioli, Chur, both of Switzerland; Gebhard Gantner, Nenzing, Austria; Peter Goepfert, Aeugst, Switzerland

[73] Assignee: Hilti Aktiengesellschaft, Schaan, Liechtenstein

[21] Appl. No.: 09/208,026

[22] Filed: Dec. 9, 1998

[30] Foreign Application Priority Data

Dec. 12, 1997 [DE] Germany ..... 197 55 407

[51] Int. Cl.[7] ..... B25C 1/14

[52] U.S. Cl. ..... 227/10

[58] Field of Search ..... 227/9, 10, 11, 227/130

[56] References Cited

U.S. PATENT DOCUMENTS

| | | | |
|---|---|---|---|
| 3,565,313 | 2/1971 | Seghezzi et al. | 227/10 |
| 3,820,703 | 6/1974 | Rangger | 227/10 |
| 4,074,843 | 2/1978 | Oesterle | 227/10 |
| 4,374,567 | 2/1983 | Combette et al. | 227/9 |
| 4,405,072 | 9/1983 | Kindle et al. | 227/10 |
| 5,048,740 | 9/1991 | Beton | 227/10 |
| 5,213,247 | 5/1993 | Gschwend et al. | 227/10 |
| 5,332,140 | 7/1994 | Almeras et al. | 227/9 |

*Primary Examiner*—Scott A. Smith
*Attorney, Agent, or Firm*—Brown & Wood, LLP

[57] ABSTRACT

A setting tool for driving-in nail-shaped fastening elements into hard constructional components and including a housing (10, 110), a guide cylinder (20, 120) displaceable in the housing (10, 110) in a direction opposite to a setting direction against a spring-biasing force, a drive piston (40, 140) axially displaceable in the guide cylinder (20, 120), and a pivotal resetting element (50, 150) having a first lever arm (51, 151) cooperating with the drive piston (40, 140) for resetting the drive piston (40, 140) to its inoperative position and a second lever arm (152) cooperating with the guide cylinder (20, 120) for displacing the first lever arm (151) in accordance with displacement of the guide cylinder (120).

8 Claims, 6 Drawing Sheets

SETTING TOOL

BACKGROUND OF THE INVENTION

1. Field of the Invention

The present invention relates to a setting tool for driving nail-shaped fastening elements in a hard constructional component and including a housing, a guide cylinder, a drive piston axially displaceable in the guide cylinder and having a stem and a head, and a resetting element pivotable about an axle supported in the housing and having a lever arm cooperating with a front, in a setting direction, surface of the drive piston head.

2. Description of the Prior Art

At present, setting tools, e.g., explosive powder charge operated setting tools are used for driving nail-shaped fastening elements in a hard constructional component, such as concrete, stone of steel. Such setting tool is disclosed in German Publication No. 1,812,207. The setting tool disclosed in this publication includes a housing, a guide cylinder at least partially located in the housing, and a drive piston axially displaceable in the guide cylinder for driving in fastening elements. After each setting process, the drive piston is return to its initial position by a resetting element which is pivotally supported in the housing. The resetting element projects through a side opening in the guide cylinder into the interior of the guide cylinder and cooperates there with a front, in the setting direction, end surface of the drive piston head. The resetting element is pivotally supported by axle which projects through an opening formed in the housing and which extends perpendicular to the setting direction. The resetting element cooperates with a pressure spring supported against the housing and a stop surface of the resetting element which faces in the setting direction.

In each setting process, the drive piston is displaced in the setting direction with a very high speed. The high speed of the drive piston results in extremely high accelerations and loads applied at least to a section of the resetting element which engages the front end surface of the drive piston head. Because of its large length, the resetting element has a big mass, which results in large vibrations of the entire setting tool each time the resetting element runs on a stop limiting the displacement of the resetting element in the setting direction. Though the stop in formed of a material having damping characteristics, only a small portion of the kinetic energy of the resetting element is damped. Therefore, an early wear and damage of all involved parts of the setting tool cannot be prevented.

Accordingly, an object of the present invention is to provide a reliable and easily operable setting tool having a resetting element with a very high service life.

SUMMARY OF THE INVENTION

This and other objects of the present invention, which will become apparent hereinafter, are achieved by providing a setting tool in which the guide cylinder is displaced in the housing in a direction opposite to the setting direction against a spring-biasing force, and the resetting element is provided with a second lever arm cooperating with the guide cylinder for displacing the first lever arm in accordance with the displacement of the guide cylinder.

Upon the setting tool being pressed against a constructional component, the guide cylinder moves in the direction opposite to the setting direction, and the resetting element pivots in such a way that the lever arm of the resetting element, which cooperates with the front end surface of the drive piston head, always at the latest shortly before the start of the setting process, moves out of the displacement region of the drive piston head in which the drive piston reciprocates. The conversion of the movement of the guide cylinder relative to the housing in a pivotal movement of the resetting element is effected with the second lever arm of the resetting element which cooperates with the guide cylinder. As a result, the transmission of the high speed of the drive piston to the respective lever arm or the resetting element during a setting process is prevented.

For converting the relative movement between the guide cylinder and the housing into the pivotal movement of the resetting element, the second lever arm of the resetting element is provided, advantageously, with a profile which cooperates with a mating profile provided on the guide cylinder. Based on manufacturing considerations, preferably, the profile of the second lever arm is formed as a control curve, and the mating profile on the guide cylinder is formed as a control cam.

To provide for a most possible backlash-free conversion of the relative movement between the guide cylinder and the housing into the pivotal movement of the resetting element, advantageously, both the profile of the second lever arm and the mating profile of the guide cylinder are formed as toothed profiles.

Cooperation of the profile of the second lever arm with the mating profile of the guide cylinder results in a formlocking connection between the second lever arm and the guide cylinder. To provide for swinging out of the second lever arm into its release position shortly before the start of the setting process, the formlocking connection between the second lever arm and the guide cylinder should be broken shortly before the setting tool reaches its maximum pressed condition against the constructional component. The breaking of the formlocking connection is achieved by forming the mating profile on a detent member associated with the guide cylinder and pivotable against a biasing force of a support spring which provides for connection of the detent member with the guide cylinder for their joint displacement. The pivotal movement of the detent member is controlled by a cam provided on the detent member and cooperating with a control curve associated with the housing. A spring element, which is arranged between the housing and the resetting element, provides for an automatic pivoting of the second lever arm in a setting direction into its release position.

Forming the spring element, which cooperates with the resetting element, as a torsion spring surrounding the resetting element supporting axle prevents collision of the spring element with other movable parts inside the housing.

In the release position, the first lever arm of the resetting element projects partially into the interior of the guide cylinder and, thus, in plane of axial projection of the drive piston. When removing the drive piston out of the guide cylinder, it should be insured that the first arm would not project into the interior of the guide cylinder, as the drive piston can only be removed in the setting direction. The swinging of the first lever arm out of the interior of the guide cylinder is insured by displacing the entire resetting element relative to the housing in a direction substantially transverse to the setting direction. To this end, the resetting element supporting arm is displaced relative to the guide cylinder. The support arm can be connected with the housing, e.g., with a pivoting support which insures pivoting of the support arm relative to the housing.

BRIEF DESCRIPTION OF THE DRAWINGS

The features and objects of the present invention will become more apparent, and the invention itself will be the best understood from the following detailed description for the preferred embodiments when read with reference to the accompanying drawings, wherein.

DETAILED DESCRIPTION OF THE PREFERRED EMBODIMENT

Figure 1:
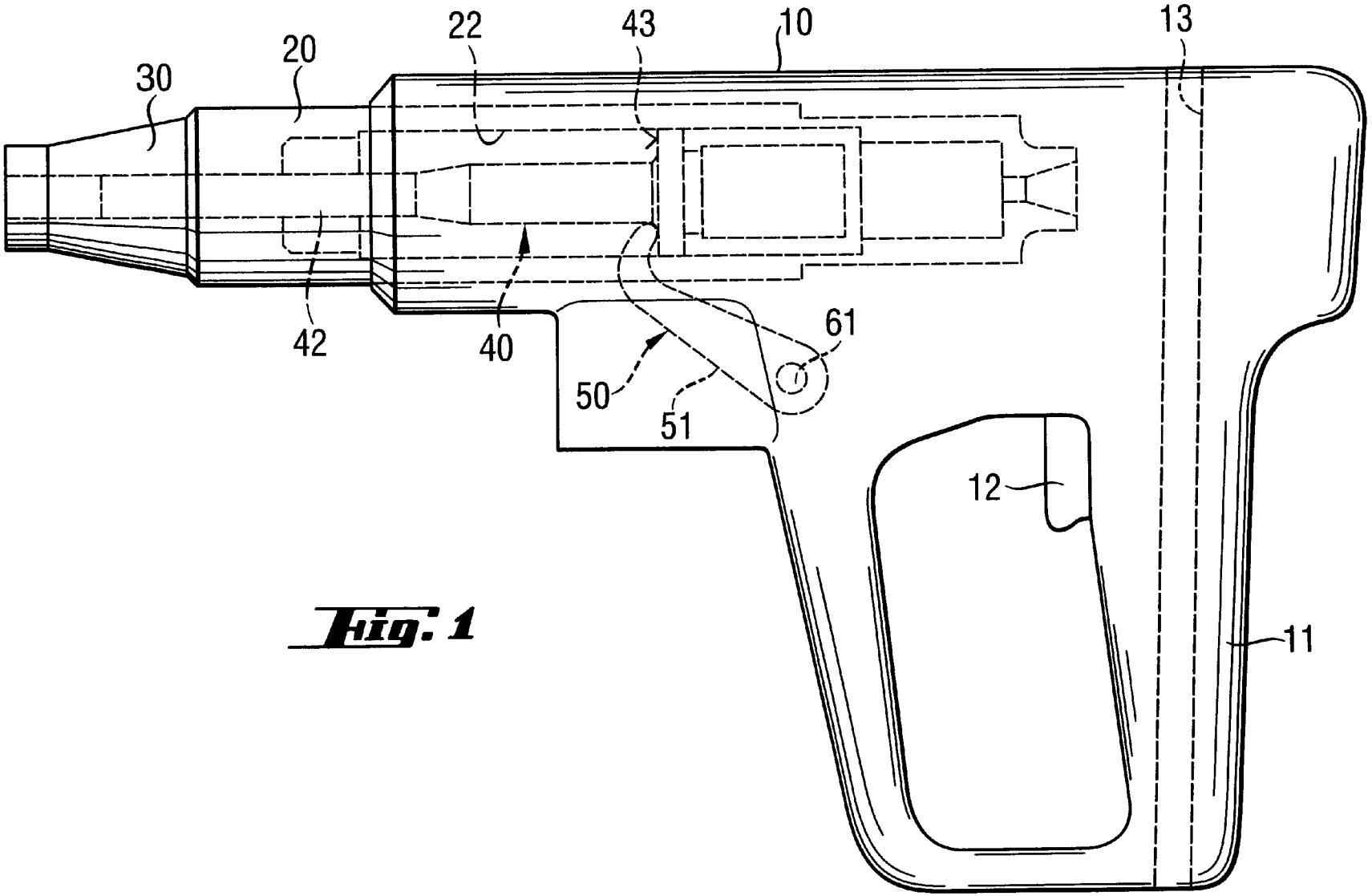
FIG. 1 shows a schematic side elevational view of a setting tool according to the present invention in the tool inoperative position.

A setting tool according to the present invention, which is shown in FIG. 1, includes a housing 10, a handle 11 formed integrally with the housing 10, a trigger 12, and a guide channel 13 for cartridge strips (not shown). Inside the housing 10, there is located a guide cylinder 20 projecting, in the setting direction, beyond the housing 10 and axially displaceable relative to the housing 10. At its free, in the setting direction, end, the guide cylinder 20 is adjoined by a fastener guide 30. A drive piston 40, which is formed of a stem 42 and a head 41 projecting radially beyond the stem 42, is located in the guide cylinder 20. A resetting element 50 displaces the drive piston 40, after each setting process, in the drive piston initial position inside the guide cylinder 20. An axle 61 provides for the pivotal movement of the resetting element 50 which is rotatably supported on the axle 61. During the displacement of the drive piston 40 in its initial position, a lever arm 51 of the resetting element 50 cooperates with a front, in the setting direction, surface 43 of the head 41 of the drive piston 40.

Figure 2:
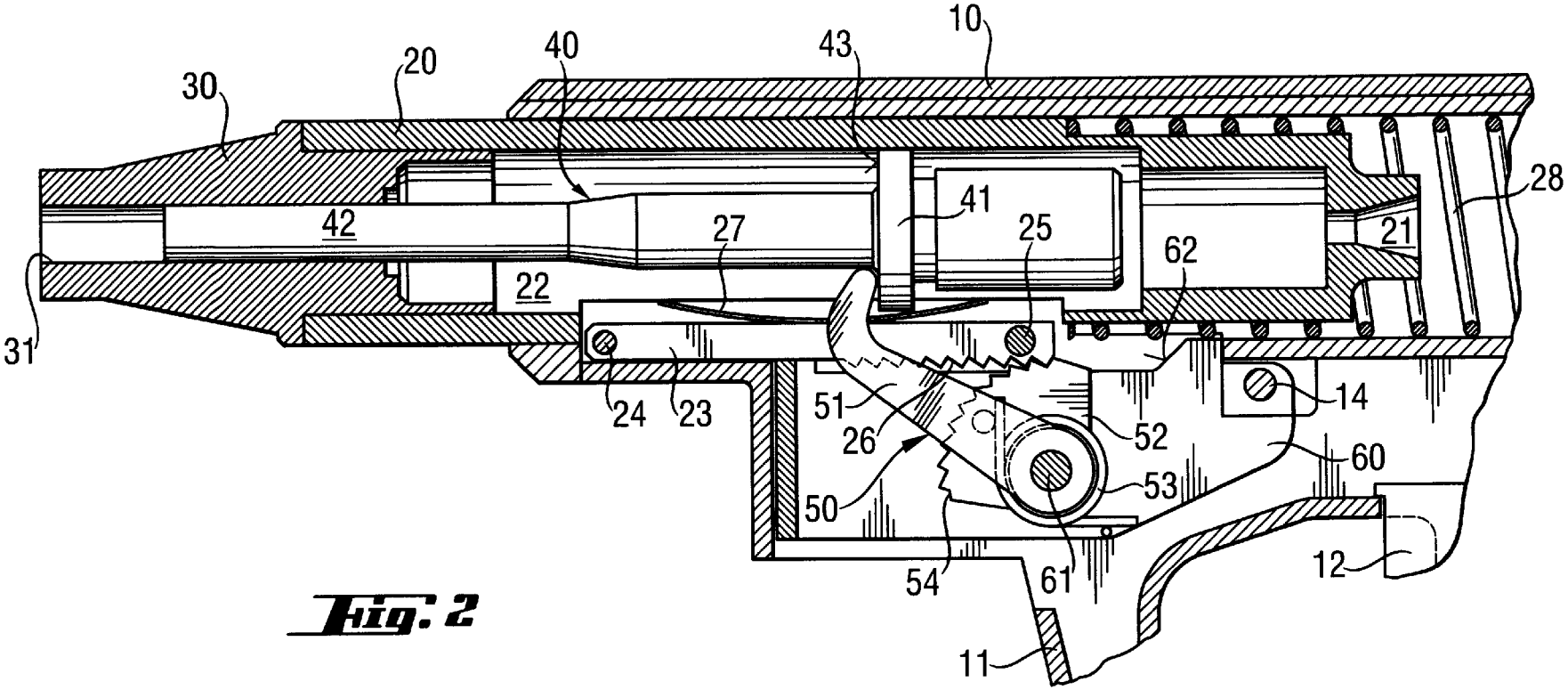
FIG. 2 shows an enlarged cross-sectional view of a portion of the setting tool shown in FIG. 1, with the resetting element in its release position and a drive piston in its intermediate position.

As shown in FIG. 2, the axle 61, which supports the lever 50, forms a portion of a support arm 60 pivotable relative the housing 10. The support arm 60 pivots in such a manner that the lever arm 51, which projects into an interior 22 of the guide cylinder 20, can swing out to enable movement of the drive piston 40 in the setting direction in the guide cylinder 20. The support arm 60 is pivotally supported on a pivoting support 14 which connects the support arm 60 with the housing 10.

The guide cylinder 20 is displaced in the housing 10 in the direction opposite to the setting direction against a biasing force of a spring 28. The rear, in the setting direction, end of the guide cylinder 20 is provided with a cartridge chamber 21 which is connected with the interior 22 of the guide cylinder 20 by a connection channel. In addition to the lever arm 51, the resetting element 50 has another lever arm 52. The arm 52 has a shape of a segment of a circle and the circumference of which has a toothed profile. A hollow cylinder section, which is surrounded by a spring member 53, is arranged between the two arms 51 and 52. The spring member 53 is formed as torsion spring the opposite ends of which cooperate with one of the two arms 51, 52 and a stop provided on the support arm 60. The hollow cylinder section, which is arranged between the two arms 51, 52, can, e.g., project sidewise relative to one of the lever arms 51, 52.

The drive cylinder 20 cooperates with a detent member 23 which extends parallel to the setting direction and pivots about an axle 24 in the same pivot plane as the lever arm 52. The detent member 23 has a toothed mating profile 26 which is formlockingly cooperates with the toothed profile 54 of the other lever arm 52. A support spring 27 biases the detent member 23 against the other lever arm 52 so that the teeth of the mating profile 26 of the detent member 23 project into the toothed profile 54 of the other lever arm 52. A pin-shaped cam 25, which is provided on the detent member 23, displaces the detent member 23 against a biasing force of the support spring 27 when the cam 25, upon the displacement of the guide cylinder 20 in the direction opposite to the setting direction, runs up a control profile 62 provided on the support arm 60. This displacement of the detent member 23 provides for disengagement of the mating toothed profile 26 of the detent member 23 from the toothed profile 54 of the other lever arm 52.

The setting process with the setting tool shown in FIG. 1 is effected as follows.

FIG. 2 shows the setting tool in its inoperative position. The resetting element 50 is in its release position, and the lever arm 51 engages the front surface 43 of the head 41 of the piston 40. The drive piston 40 is in its intermediate position. The mating toothed profile 26 of the detent member is formlockingly engaged with the toothed profile 54 of the other lever arm 52.

Figure 3:
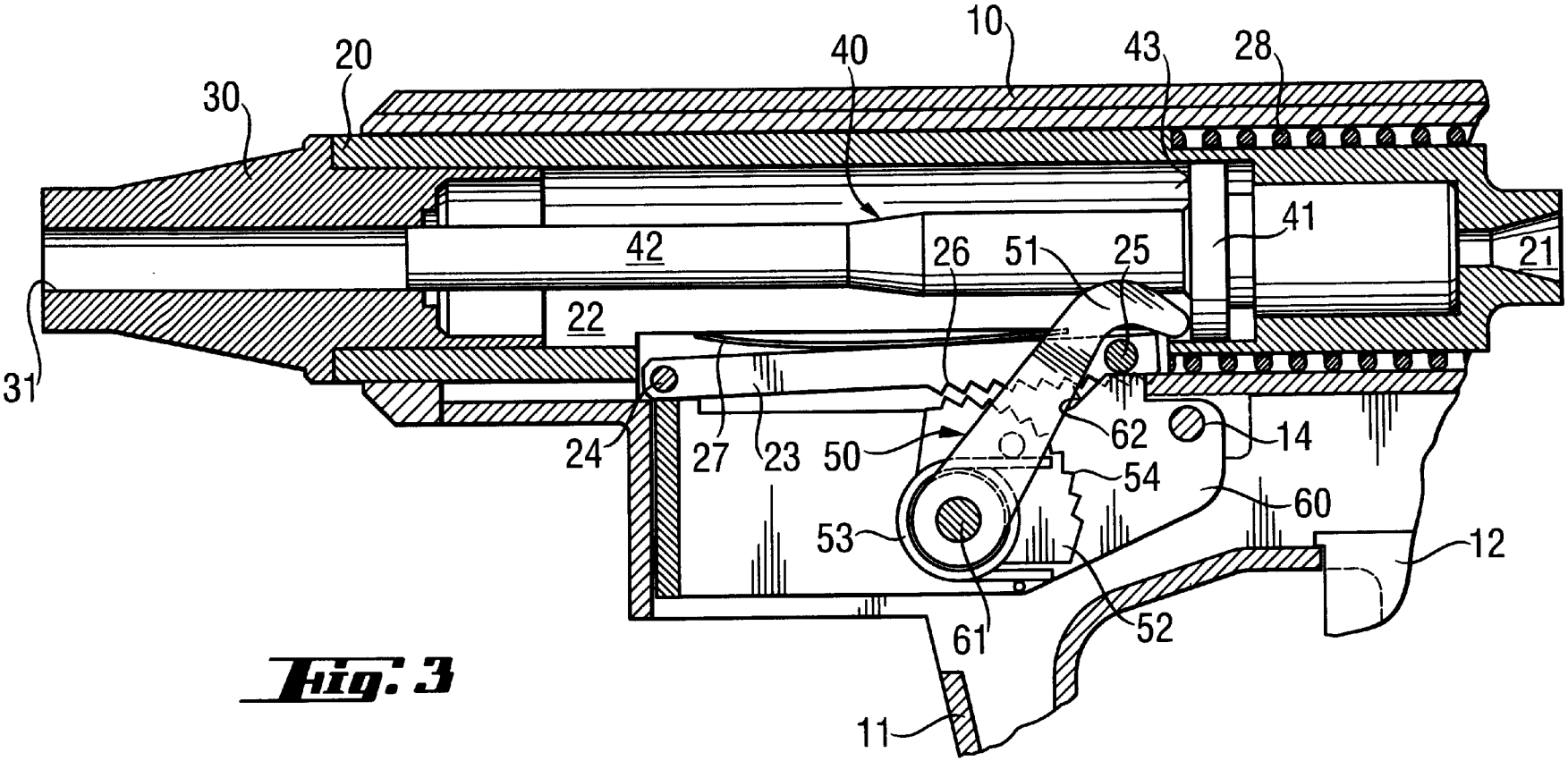
FIG. 3 shows an enlarged cross-sectional view of a portion of the setting tool shown in FIG. 1 in a position in which the setting tool is pressed against a constructional component (not shown), with the resetting element in its operational position and the drive piston in its initial position in the guide cylinder.

For effecting the setting process, a fastening element (not shown) is fed into a central bore 31 of the fastener guide 30. Then, the fastener guide 30 is pressed against a constructional component (also not shown). With the fastener guide 30 being pressed against the constructional component, the guide cylinder 20 is displaced in the direction opposite to the setting direction to its ignition-ready position shown in FIG. 3. During the displacement of the guide cylinder 20, the toothed profile 54 of the other lever arm 52 rolls off the mating toothed profile 26 of the detent member 23, which is displaced in the direction opposite to the setting direction, together with the guide cylinder 20. This causes the entire resetting member 50 to pivot, preloads the torsion spring 53, and the drive piston 40 is displaced into its ignition position. Shortly before the end of axial displacement of the guide cylinder 20 inside the housing 10, the pin-shaped cam 25 runs up the control profile 62 on the support arm 60 which results in lifting of the detent member 23 off the other lever arm 52 and disengagement of the mating toothed profile 26 from the toothed profile 54. Immediately, the resetting element 50 pivots into its release position. In the release position of the resetting element 50, the first lever arm 51 lies outside of the axial displacement region of the head 41 of the drive piston 40, and the drive piston 40 is not parallel to the lever arm 51.

Upon displacement of the guide cylinder 20 in the direction opposite to the setting direction, the cartridge chamber 21 laps over a cartridge (not shown), and an ignition or firing mechanism (not shown) is activated upon the trigger 12 being depressed.

Figure 4:
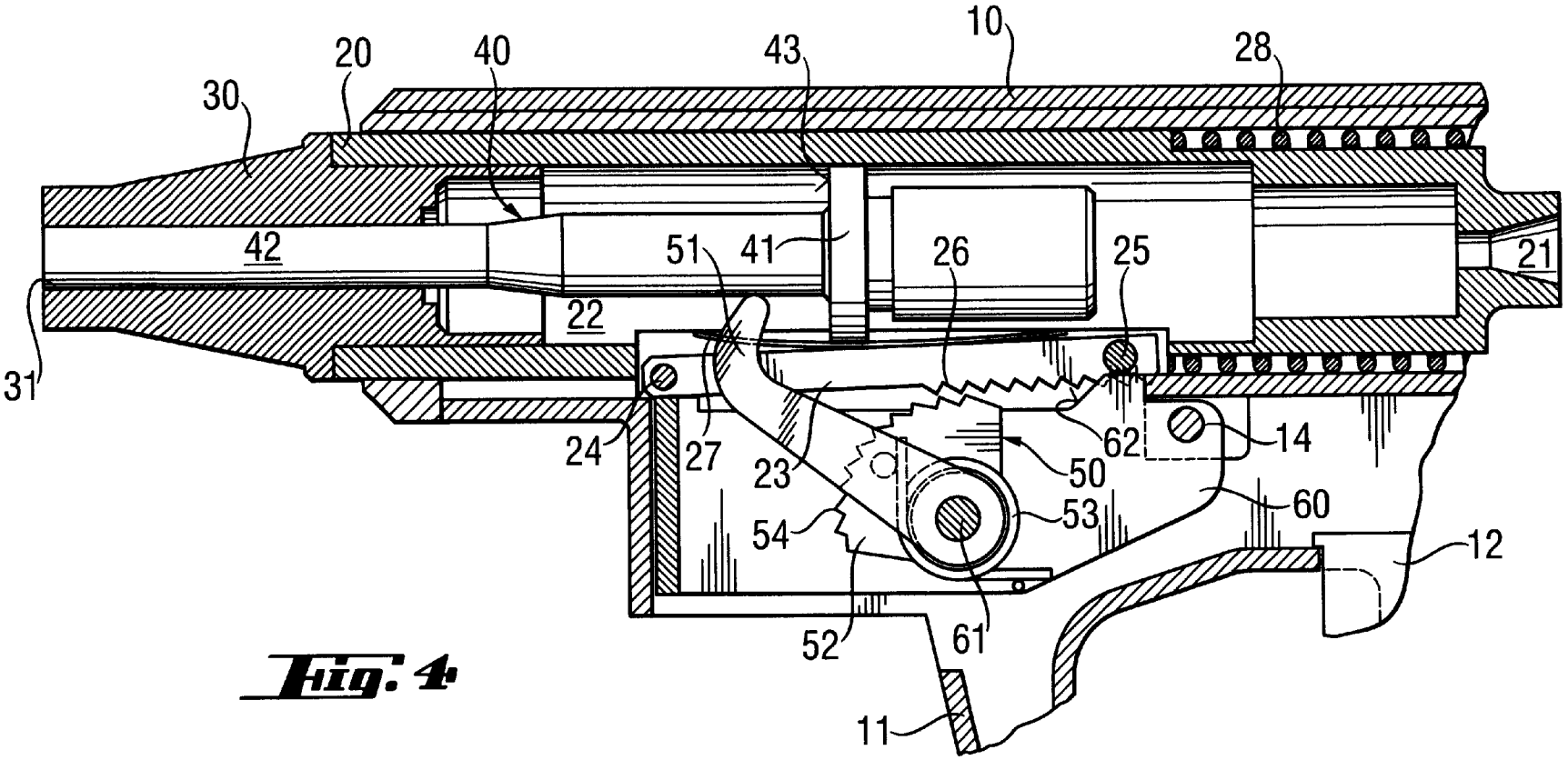
FIG. 4 shows an enlarged cross-sectional view of the portion of a setting tool shown in FIG. 1 in a position in which the setting tool is pressed against a constructional component (not shown), with the resetting element in its release position and with the drive piston in its end, drive-in position.

FIG. 4 shows the arrangement of elements of the setting tool after the fastening element has been driven-in. The detent member 23 is still lifted off the other lever arm 52, and the free end of the stem 42 of the driven piston 40 lies in the same plane as the front, in the setting direction, end of the fastener guide 30. This position characterizes an end, drive-in position of the drive piston 40.

Upon lifting of the setting tool off the constructional component, the spring 28 displaces the guide cylinder 20 in the setting direction. The front surface 43 of the drive piston head 41 comes into contact with the first lever arm 51 which prevents further displacement of the drive piston 40 in the setting direction. At the end of the displacement of the guide cylinder 40 in the setting direction, the setting tool is again in its inoperative position shown in FIG. 2.

Figure 5:
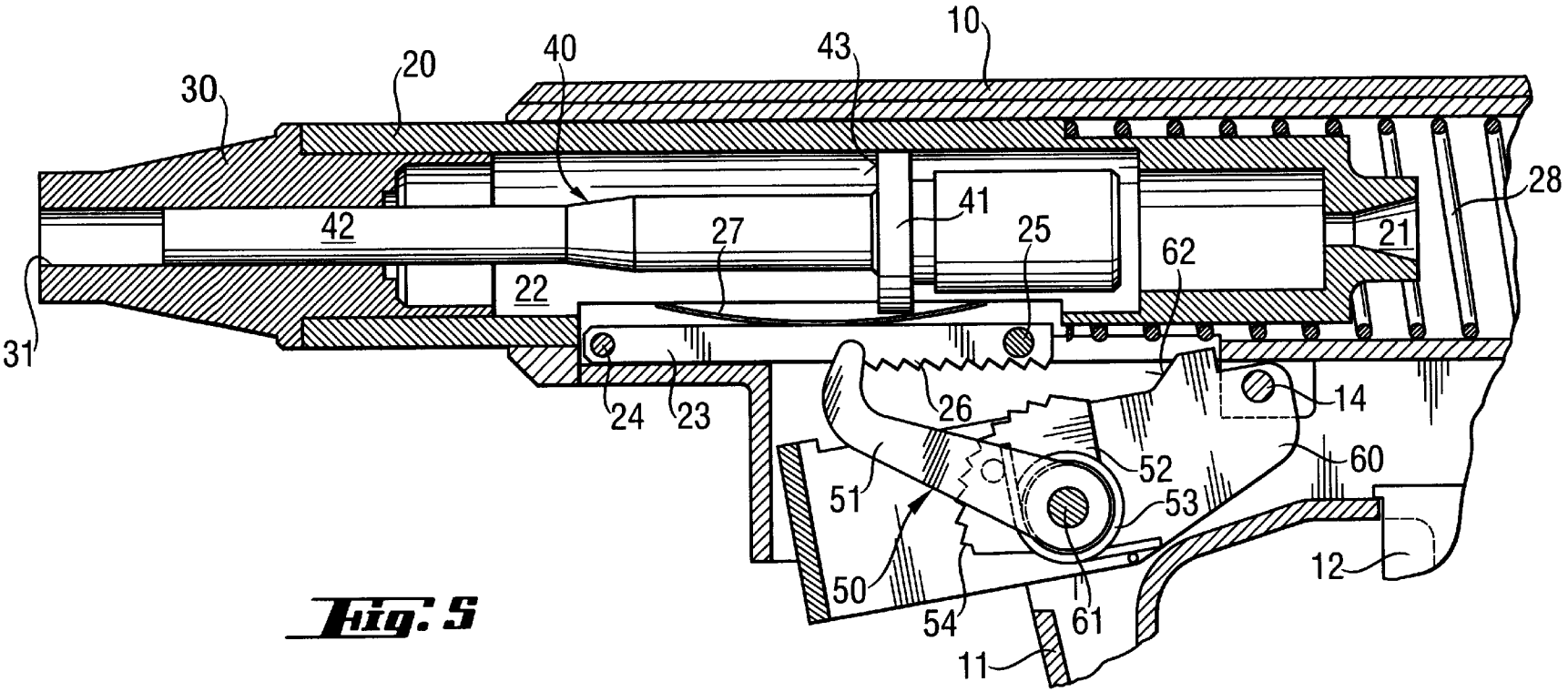
FIG. 5 shows an enlarged cross-sectional view of a portion of the setting tool shown in FIG. 1 in a position in which the setting tool is lifted off constructional component, with the resetting element in its release position and a carrier arm being swinged out, and with the drive piston in its intermediate position.

FIG. 5 shows the support arm 60 in an open position, and the lever arm does not project any more into the interior of the drive cylinder 20.

The setting tool can also be formed without a pivotal support arm 60. In this case, the axle 61, which supports the resetting element 50, forms part of the housing 10.

Figure 6:
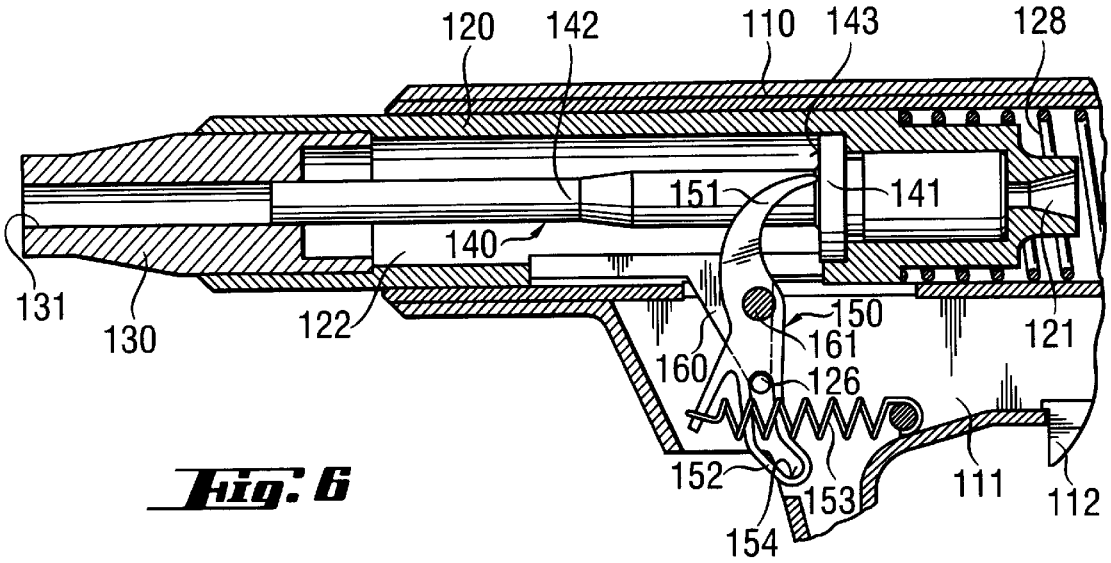
FIG. 6 shows an enlarged cross-sectional view of a portion of another embodiment of the setting tool in its lift-off position and with the resetting element in its operational position.
Figure 7:
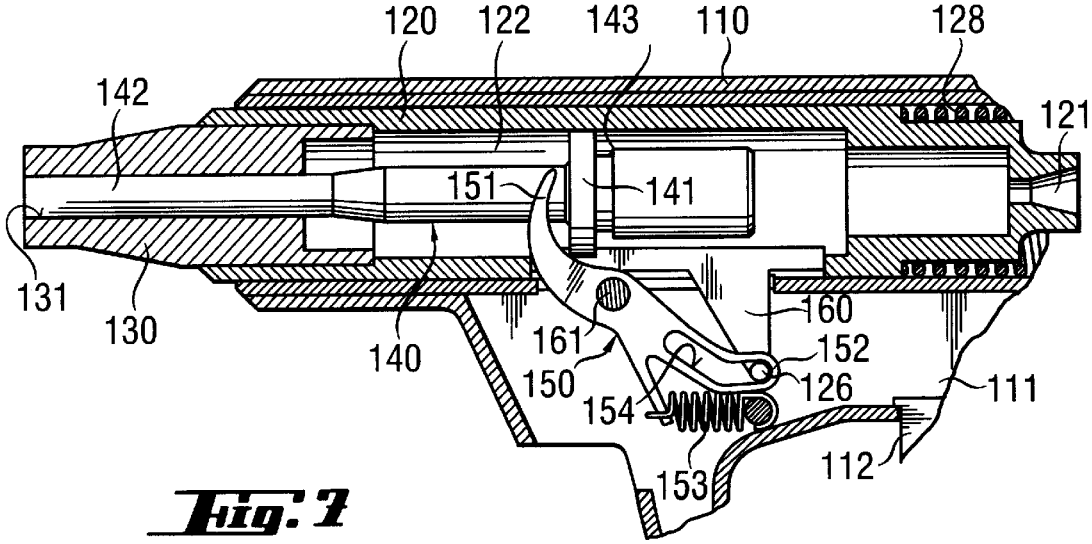
FIG. 7 shows an enlarged cross-sectional view of the portion of the setting tool shown in FIG. 6, with the setting tool in a position in which it is pressed against a constructional component and with the resetting element in its release position.

A second embodiment of a setting tool according to the present invention, which is shown in FIGS. 6 and 7, includes a housing 110, a handle 111 formed integrally with the housing 10, a trigger 112. Inside the housing 10 there is located a guide cylinder 120 projecting, in the setting direction, beyond the housing 110 and axially displaceable relative to the housing 110. At its free, in the setting direction, end, the guide cylinder 120 is adjoined by a fastener guide 130 having a central bore 131. The end region of the guide cylinder 120 remote from the fastener guide 130 has a cartridge chamber 121. A drive piston 140, which is formed of a stem 142 and a head 141 projecting radially beyond the stem 42, is located in the guide cylinder 120.

A resetting element 150 is pivotally supported on the axle 161 secured in the housing 110. The resetting element 150 has two lever arms 151, 152. The lever arm 151 cooperates with a front, in a setting direction, surface 143 of the drive piston head 141. The second lever arm 152 is provided with a control curve profile 154 which is formed by an elongate slot closed from all sides. A control cam 126 extends into the elongated slot. The control cam 126 forms part of a guide cylinder 120 and is provided on an end of a support arm 160 extending sidewise of the guide cylinder 120. The support arm 160 extends through an opening formed in the housing 110. The second lever arm 152 cooperates with a spring member 153 formed as a tension spring.

FIG. 6 shows the setting tool in its lift-off position, with the drive piston 140 in its ignition-ready position. The control cam 126 is located at an end of the control curve-forming slot which is adjacent to the axle 61.

Upon the setting tool being pressed against a constructional component (not shown), the guide cylinder 120 is displaced in the direction opposite to the setting direction. Upon displacement of the guide cylinder 120, the control cam 126 slides along the control curve profile 154 of the second lever arm 152. At that, the resetting element 150 pivots in a direction in which the first lever arm 151 is lifted off the front surface 143 of the drive piston head 141 and moves in the setting direction until the resetting element 150 reaches its release position. In the release position of the resetting element 150, the lever arm 151 is located outside of the displacement region of the drive piston head 141, and the control cam 126 is located in that end of the control curve-forming slot which is remote from the axle 161.

After the ignition of a cartridge which is located in the cartridge chamber 121, the drive piston 140 is displaced in the setting direction and drives a fastening element (not shown), which is located in the central bore 131 of the fastener guide 130 into the constructional component. This position of the drive piston 140 is shown in FIG. 7. After the setting tool has been lifted off the contructional component, the spring 128 displaces the guide cylinder 120 in the setting direction. During the displacement of the guide cylinder 120 in the setting direction, the control cam 126 slides along the control curve, pivoting the resetting element 150 about the axle 161. At that, the first lever arm 151 engages the front surface 143 of the drive piston head 141, displacing the drive piston relative to the guide cylinder to its original position shown in FIG. 6.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A setting tool for driving-in nail-shaped fastening elements into hard constructional components, the setting tool comprising a housing (10, 100); a guide cylinder (20, 120) displaceable in the housing (10, 110) in a direction opposite to a setting direction against a spring-biasing force; a drive piston (40, 140) axially displaceable in the guide cylinder (20, 120); a pivotal resetting element (50, 150) having a first lever arm (51, 151) cooperating with the drive piston (40, 140) for resetting the drive piston (40, 140) to an inoperative position thereof and a second lever arm (152) cooperating with the guide cylinder (20, 120) for displacing the first lever arm (151) in accordance with displacement of the guide cylinder (20, 120); and axle means (61, 161) supported in the housing (10, 110) and pivotally supporting the resetting element (50, 150).

2. A setting tool according to claim 1, wherein the second lever arm (52, 152) has a profile (54, 154) cooperating with a mating profile (26, 126) provided on the guide cylinder (20, 120).

3. A setting tool according to claim 2, wherein the profile (154) of the second lever arm (152) is formed as a control curve, and the mating profile (126) of the drive cylinder (120) is formed as a control cam (126).

4. A setting tool according to claim 2, wherein both the profile (54) of the second lever arm (52) and the mating profile (26) of the guide cylinder (20) are formed as toothed profiles.

5. A setting tool according to claim 4, wherein the mating profile (26) is provided on a detente member (23) associated with the guide cylinder (20) and pivotable against a biasing force of a support spring (27).

6. A setting tool according to claim 1, further comprising spring means (53, 153) arranged between the housing (10, 110) and the resetting element (50, 150) for displacing the first lever arm (51, 151) in the setting direction.

7. A setting tool according to claim 6, wherein the spring means (53) if formed as a torsion spring surrounding the axle (61).

8. A setting tool according to claim 1, further comprising a support arm (60) for supporting the axle (61) and displaceable relative to the guide cylinder.

* * * * *